US007597043B2

(12) United States Patent
Yamamoto et al.

(10) Patent No.: US 7,597,043 B2
(45) Date of Patent: Oct. 6, 2009

(54) DIAPHRAGM PUMP

(75) Inventors: Shinya Yamamoto, Kariya (JP); Makoto Yoshikawa, Kariya (JP); Takao Mishina, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 367 days.

(21) Appl. No.: 11/562,761

(22) Filed: Nov. 22, 2006

(65) Prior Publication Data

US 2007/0148015 A1 Jun. 28, 2007

(30) Foreign Application Priority Data

Nov. 24, 2005 (JP) ..... 2005-339087

(51) Int. Cl.
*F01B 19/00* (2006.01)

(52) U.S. Cl. ..... 92/105; 92/98 R

(58) Field of Classification Search ..... 92/98 R, 92/99, 100, 103 R, 105
See application file for complete search history.

(56) References Cited

U.S. PATENT DOCUMENTS 5,291,822 A * 3/1994 Alsobrooks et al. ..... 92/100
5,468,128 A 11/1995 Benalikhodja
6,080,685 A * 6/2000 Eady ..... 92/103 R
6,145,430 A * 11/2000 Able et al. ..... 92/100

FOREIGN PATENT DOCUMENTS

| | | |
|---|---|---|
| DE | 718205 | 3/1942 |
| DE | 69301902 T2 | 9/1996 |
| JP | 7-14179 | 3/1995 |
| JP | 2001-115967 | 4/2001 |

* cited by examiner

*Primary Examiner*—Michael Leslie
(74) *Attorney, Agent, or Firm*—Woodcock Washburn LLP

(57) ABSTRACT

A diaphragm unit includes a plurality of diaphragms which are layered on top of each other. A case and the diaphragm unit define a pump chamber. The diaphragm unit has a first surface and a second surface on the side opposite to the first surface. A support member for supporting the diaphragm unit has a first support surface for supporting the first surface and a second support surface for supporting the second surface. The support member allows the diaphragms to slide between the first support surface and the second support in case here the diaphragm unit changes its form. Thus, the durability of the diaphragm is improved.

11 Claims, 3 Drawing Sheets

DIAPHRAGM PUMP

BACKGROUND OF THE INVENTION

The present invention relates to a diaphragm pump having a diaphragm which performs pumping action by changing its form.

FIG. 6 shows the diaphragm pump disclosed in Japanese Laid-Open Utility Model Publication No. 7-14179. A device case 91 of this pump is provided with a block 94 and a pressing plate 98 which is fixed to this block 94. The block 94 and the pressing plate 98 sandwich an outer peripheral portion 92*a* of a diaphragm 92. The diaphragm 92 and the block 94 define a pump chamber 95.

The above described pump is further provided with a rod 96 and a support member 97. The rod 96 is made to move in a reciprocating manner by a driving source, such as an electric powered motor (not shown). The support member 97 links the rod 96 to the center portion of the above described diaphragm 92. The support member 97 is provided with a first movable member 97*a* which is placed on the upper surface of the diaphragm 92, as viewed in FIG. 6, and a second movable member 97*b* which is placed on the lower surface of the diaphragm 92. The first movable member 97*a* and the second movable member 97*b* sandwich the center portion of the diaphragm 92.

When the rod 96 moves in a reciprocating manner, the diaphragm 92 changes its form (is displaced), so that the volume in the pump chamber 95 increases or decreases. In case of the suction process, during which the volume in the pump chamber 95 increases, a fluid is sucked into the pump chamber 95. In case of the discharge process, during which the volume in the pump chamber 95 decreases, the fluid is discharged from the pump chamber 95.

Meanwhile, the device case 91 sandwiches the outer peripheral portion 92*a* of the diaphragm 92, while the support member 97 of the driven body 93 sandwiches the center portion of the diaphragm 92. That is to say, there is constant stress due to the above described sandwiching in the outer peripheral portion 92*a* and the center portion of the diaphragm 92. As a result, an excessive load is continuously applied to the diaphragm 92, decreasing the durability of the diaphragm 92.

SUMMARY OF THE INVENTION

An object of the present invention is to provide a diaphragm pump that improves the durability of the diaphragm.

According to one aspect of the invention, a diaphragm pump including a case and a diaphragm unit is provided. The diaphragm unit includes a plurality of diaphragms which are layered on top of each other. The case and the diaphragm unit define a pump chamber. The diaphragm unit has a first surface and a second surface on the side opposite to the first surface. When the diaphragm unit changes its form, the volume in the pump chamber increases or decreases. As a result, a fluid flows into or out of the pump chamber. A support member for supporting the diaphragm unit has a first support surface for supporting the first surface and a second support surface for supporting the second surface. The support member allows the diaphragms to slide between the first support surface and the second support surface in case where the diaphragm unit changes its form.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF ILLUSTRATIVE EMBODIMENTS

In the following, the first embodiment of the present invention is described in reference to FIGS. 1A to 2C.

Figure 1A:
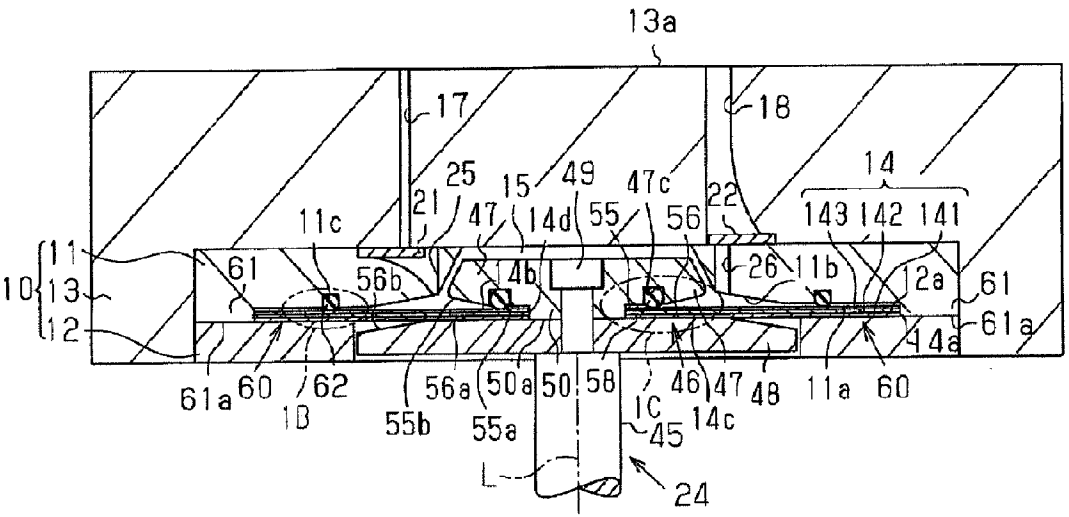
FIG. 1A is a cross-sectional view showing a diaphragm pump according to a first embodiment of the present invention.

As shown in FIG. 1A, a diaphragm pump of the present embodiment has a device case 10 as a case. The device care 10 is provided with a main body case 13, a first fixed member 11, which is an annular block contained inside the main body case 13, and a second fixed member 12, which is an annular pressing plate joined to this first fixed member 11. The main body case 13 is in cylindrical form with a lid 13*a*, and has an opening on the bottom as viewed in FIG. 1A. The second fixed member 12 tightly closes the opening in the main body case 13. The first fixed member 11 is located between the second fixed member 12 and the lid 13*a*. The first fixed member 11 and the second fixed member 12 are fixed to the main body case 13 with fixing members such as bolts (not shown).

In the device case 10, a diaphragm unit 14 in disc form is contained between the first fixed member 11 and the second fixed member 12. The diaphragm unit 14 is made of a metal and has flexibility and a uniform thickness. The device case 10 has a fixed support member 60 as a second support member. The fixed support member 60 supports the outer peripheral portion 14*a* of the diaphragm unit 14 against the device case 10. A movable support member 46, which is a first support member, links a driven body 24 to the center portion of the diaphragm unit 14. The center portion of the diaphragm unit 14 has a hole for linking 14*d*. The movable support member 46 is provided with a first movable member 47 and a second movable member 48.

The diaphragm unit 14 has a first surface 14*b*, which is an upper surface facing a pump chamber 15, and a second surface 14*c*, which is a lower surface on the side opposite to the first surface 14*b*. The first surface 14*b* faces the first fixed member 11 and the first movable member 47. The second surface 14*c* faces the second fixed member 12 and the second movable member 48.

A hole 11*b* in the center portion of the annular first fixed member 11 extends from the second fixed member 12 to the lid 13*a*. The diaphragm unit 14 closes the opening of the hole 11*b* which faces the second fixed member 12. The lid 13*a* closes the other opening of the hole 11*b*. The diaphragm unit 14 and the lid 13*a* define the pump chamber 15, which includes the space inside the hole 11*b*.

The main body case 13 has a suction path 17 and a discharge path 18. An external pipe for low pressure (not shown) is connected to the suction path 17. An external pipe for high pressure (not shown) is connected to the discharge path 18. The first fixed member 11 has a suction port 25 which connects the pump chamber 15 to the suction path 17, and a discharge port 26 which connects the pump chamber 15 to the discharge path 18. The first fixed member 11 and the main body case 13 sandwich a suction valve 21 made of a reed valve. The suction valve 21 is located on the border between the suction port 25 and the suction path 17, and is capable of closing the suction path 17. The first fixed member 11 and the main body case 13 sandwich a discharge valve 22 made of a reed valve. The discharge valve 22 is located between the discharge port 26 and the discharge path 18, and is capable of closing—the discharge path 18.

The driven body 24 has a rod 45. A power transmission mechanism (not shown) links the rod 45 to a driving source, such as an electric powered motor (not shown). The power transmission mechanism converts the rotational movement of, for example, an electric powered motor, to a reciprocating movement. The driving source makes the rod 45 move in a reciprocating manner in the direction along the axial line L of the rod 45. The rod 45 moves in a reciprocating manner, in the, upward and downward direction as viewed in FIG. 1A. The rod 45 is linked to the movable support member 46. Accordingly, when the rod 45 moves in a reciprocating manner, the diaphragm unit 14 changes its form (is displaced), and as a result, the volume in the pump chamber 15 changes.

When the rod 45 moves away from the pump chamber 15, that is to say, downward as viewed in FIG. 1A, the diaphragm unit 14 changes its form so as to move away from the lid 13*a*, and thus, the volume in the pump chamber 15 increases. In case of the suction process, during which the volume in the pump chamber 15 increases, the gas in the suction path 17 pushes open the suction valve 21 and is sucked into the pump chamber 15. Conversely, when the rod 45 moves toward the lid 13*a*, that is to say, upward as viewed in FIG. 1A, the diaphragm unit 14 changes its form so as to move toward the lid 13*a*, and thus, the volume in the pump chamber 15 decreases. In case of the discharge process, during which the volume in the pump chamber 15 decreases, the gas in the pump chamber 15 pushes open the discharge valve 22 and is discharged into the discharge path 18. As a result, the diaphragm pump performs pumping action and conveys the gas.

Next, the support structure for the diaphragm unit 14 is described.

The above described diaphragm unit 14 has a first diaphragm 141, a second diaphragm 142 and a third diaphragm 143, which are layered on top of each other in sequence from the driven body 24 toward the pump chamber 15. The first to third diaphragms 141-143 have the same diameter. The above described first diaphragm 141 and second diaphragm 142 are formed of spring steel of which the elastic limit, the strength, the hardness and the tenacity exhibit relatively high values. The third diaphragm 143 is formed of stainless steel having resistance to corrosion, for example SUS316L. The degree of expansion when a tensile force works on the stainless steel is greater than the degree of expansion when a tensile force works on the spring steel.

The first diaphragm 141 and the second diaphragm 142 made of a spring steel secure the mechanical strength of the diaphragm unit 14 required to make the diaphragm pump operate. Mechanical strength means, for example, elastic limit, strength, hardness and tenacity. The third diaphragm 143 secures resistance to corrosion of the diaphragm unit 14 against gases.

The third diaphragm 143 faces the pump chamber 1*b*. The thickness of the third diaphragm 143 is smaller than that of the first diaphragm 141 and the second diaphragm 142. The thickness of the first diaphragm 141 is the same as that of the second diaphragm 142. That is to say, the first diaphragm 141 has the same mechanical strength as the second diaphragm 142. In case where a tensile force works on the diaphragm unit 14, the degree of expansion of the third diaphragm 143 is greater than that of the first diaphragm 141 and the second diaphragm 142. The third diaphragm 143 has the first surface 14*b*. The first diaphragm 141 has the second surface 14*c*.

Figure 1B:
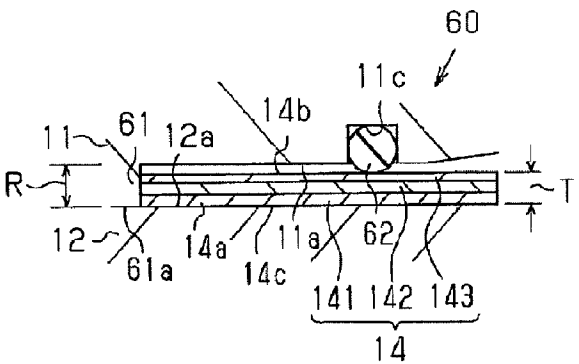
FIG. 1B is an enlarged view showing an outer peripheral portion of the diaphragm unit of FIG. 1A.
Figure 1C:
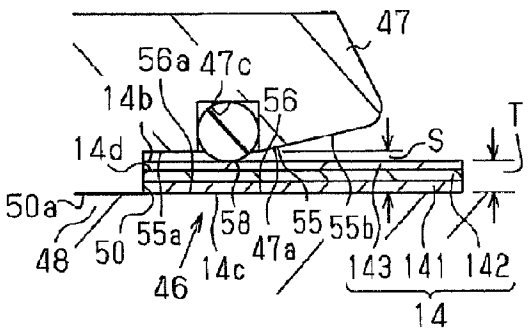
FIG. 1C is an enlarged view showing a center portion of the diaphragm unit of FIG. 1A.

As shown in FIG. 1C, a movable spacer 50, which serves as a first spacer, is integrally formed in the center portion of the first movable member 47. The movable spacer 50 is in cylindrical form and penetrates through the hole for linking 14*d* of the diaphragm unit 14. A first end surface 50*a* of the movable spacer 50 contacts the center portion of the second movable member 48. The first movable member 47 is joined directly to the second movable member 48 through the hole for linking 14*d* of the diaphragm unit 14. The first end surface 50*a* is a plane perpendicular to the axial line T, of the rod 45. As shown in FIG. 1A, a bolt 49 penetrates through the center portion of the first movable member 47 and the center portion of the second movable member 48, so that the first movable member 47 and the second movable member 48 are clamped and fixed to the rod 45.

The first movable member 47 has a first movable surface 55 which is located around the movable spacer 50. The first movable surface 55 faces the first surface 14*b* of the diaphragm unit 14 around the opening of the hole for linking 14*d*. The first movable surface 55 supports the first surface 14*b* of the diaphragm unit 14 during the suction process of the diaphragm pump. The first movable surface 55 is provided with an annular first movable plane 55*a* and an annular first movable inclining surface 55*b*, which is adjacent to the outer peripheral portion of the first movable plane 55*a*. The first movable plane 55*a* is adjacent to the movable spacer 50. The first movable plane 55*a* is perpendicular to the axial line L, of the rod 45. The first movable inclining surface 55*b* is inclined relative to the axial line L of the rod 45.

The second movable member 48 has a second movable surface 56 which is located around the movable spacer 50. The second movable surface 56 faces the second surface 14*c* of the diaphragm unit 14 around the opening of the hole for linking 14*d*. The second movable surface 56 supports the second 25 surface 14*c* of the diaphragm unit 14 during the discharge process of the diaphragm pump. The second movable surface 56 is provided with an annular second movable plane 56*a* and an annular second movable inclining surface 56*b*, which is adjacent to the outer peripheral portion of the second movable plane 56*a*. The movable spacer 50 contacts the second movable plane 56*a*. The second movable plane 56*a* is perpendicular to the axial line L of the rod 45. The second movable inclining surface 56*b* is inclined relative to the axial line L of the rod 45.

The center portion of the diaphragm unit 14 is located between the first movable surface 55 of the first movable member 47 and the second movable surface 56 of the second movable member 48 which face each other.

The first movable surface 55 has a movable groove 47*c* as an annular second containing groove of which the center is the axial line L of the rod 45. The movable groove 47*c* is located on the border between the first movable plane 55*a* and the first movable inclining surface 55*b*. The movable groove 47*c* contains a movable ring 58, which is a first 0 ring made of rubber, as a first sealing member. The movable ring 58 contacts the first surface 14*b* of the diaphragm unit 14 in such a manner as to be slidable. The movable ring 58 prevents 15 leakage of gas from the pump chamber 15. That is to say, the movable ring 58 prevents the flow of gas between the first movable surface 55 of the movable support member 46 and the first surface 14*b* of the diaphragm unit 14. Namely, the movable ring 58 prevents the flow of gas from the first surface 14*b* of the diaphragm unit 14 to the second surface 14*c* through the portion between the first movable surface 55 and the second movable surface 56.

Next, setting of the height of the movable spacer 50 of the first movable member 47 is described. That is to say, setting of a movable minimum gap S, which is the minimum gap between the first movable surface 55 and the second movable surface 56, is described. The height of the movable spacer 50 indicates the distance between the first movable plane 55*a* of the first movable surface 55 and he first end surface 50*a* of the movable spacer 50.

The movable support member 46 is provided with the movable spacer 50. Accordingly, when the first movable member 47 is pressed against the second movable member 48 by tightening the bolt 49, the movable minimum gap S between the first movable surface 55 and the second movable surface 56 is set so as to correspond to the height of the movable spacer 50. The height of the movable spacer 50 is set to no less than the thickness T of the diaphragm unit 14. That is to say, the movable minimum gap S between the first movable surface 55 and the second movable surface 56 is no less than the thickness T in the portion of the diaphragm unit 14 between the first movable surface 55 and the second movable surface 56. In other words, the gap between the first movable plane 55*a* of the first movable surface 55 and the second movable plane 56*a* of the second movable surface 56 is no less than the thickness T.

The thickness T of the diaphragm unit 14 is the total value of the thickness of the first to third diaphragms 141-143. Accordingly, the force for sandwiching the diaphragm unit 14 between the first movable surface 55 and the second movable surface 56 is prevented from becoming too strong, even 20 when the bolt 49 is firmly tightened.

Preferably, the movable minimum gap S between the first movable surface 55 and the second movable surface 56 is set to greater than the thickness T of the diaphragm unit 14. Accordingly, a gap is created in at least one of a portion between the first movable plane 55*a* of the first movable surface 55 and the first surface 14*b* of the diaphragm unit 14, and a portion between the second movable plane 56*a* of the second movable surface 56 and the second surface 14*c* of the diaphragm unit 14.

Next, the fixed support member 60 for supporting the outer peripheral portion 14*a* of the diaphragm unit 14 shown in FIG. 1B is described. The first fixed member 11 has a first fixed surface 11*a* which faces the first surface 14*b* of the diaphragm unit 14. The second fixed member 12 has a second fixed surface 12*a* which faces the second surface 14*c* of the diaphragm unit 14. The first fixed surface 11*a* and the second fixed surface 12*a* form the fixed support: member 60. The first fixed surface 11*a* and the second fixed surface 12*a* are perpendicular to the axial line L, of the rod 45. The first fixed surface 11 a and the first movable surface 55 function as a first support surface for supporting the first surface 14*b* of the diaphragm unit 14. The second fixed surface 12*a* and the second movable surface 56 function as a second support surface for supporting the second surface 14*c* of the diaphragm unit 14.

In other words, the first fixed surface 1 la avid the first movable surface 55 function as a first facing surface which faces the first surface 14*b* of the diaphragm unit 14. The second fixed surface 12*a* and the second movable surface 56 function as a second facing surface for supporting the second surface 14*c* of the diaphragm unit 14.

As shown in FIG. 1B, the first fixed member 11 has a fixed spacer 61 as a second spacer which is integrally formed. The fixed spacer 61 is a surrounding wall which protrudes in the direction of the axial line L in the periphery outside the first fixed surface 11*a*. The second end surface 61*a* of the fixed spacer 61 is perpendicular to the axial line L of the rod 45. The second end surface 61*a* contacts the second fixed member 12. The second end surface 61*a* of the fixed spacer 61 contacts the plane of the second fixed member 12 in the periphery outside the second fixed surface 12*a*. This plane is flush with the second fixed surface 12*a*.

The first fixed surface 1 la has a fixed groove 11*c* as an annular second containing groove of which the center is the axial line L of the rod 45. The fixed groove 11*c* contains a fixed ring 62, which is a second 0 ring made of rubber, as a second sealing member. The fixed ring 62 contacts the first surface lob of the diaphragm unit 14. Accordingly, the fixed ring 62 prevents leakage of gas from the pump chamber 15. That is to say, the fixed ring 62 prevents the flow of gas through the portion between the first fixed surface 11*a* of the fixed support member 60 and the first surface 14*b* of the diaphragm unit 14. Accordingly, the flow of gas from the first surface 14*b* of the diaphragm unit 14 to the second surface 14*c* through the portion between the first fixed surface 11*a* and the second fixed surface 12*a* is prevented.

The first fixed surface 11*a* and the second fixed surface 12*a* are parallel to each other throughout the entirety of the surface. Accordingly, the gap between the first fixed surface 11*a* and the second fixed surface 12*a* has a minimum value in any portion. The height of the fixed spacer 61, that is to say, the fixed minimum gap R, which is the minimum gap between the first fixed surface 11*a* and the second fixed surface 12*a*, is set to no less than the thickness T of the diaphragm unit 14 therefore, the first fixed surface 11*a* and the second fixed surface 12*a* are prevented from firmly sandwiching the diaphragm unit 14. In the present embodiment, the fixed minimum gap R is greater than the thickness T of the diaphragm unit 14. That is to say, the fixed minimum gap R is set so that a gap is created in at least one of a portion between the first fixed surface 11*a* and the first surface 14*b* of the diaphragm unit 14, and a portion between the second fixed surface 12*a* and the second surface 14*c*.

Figure 2A:
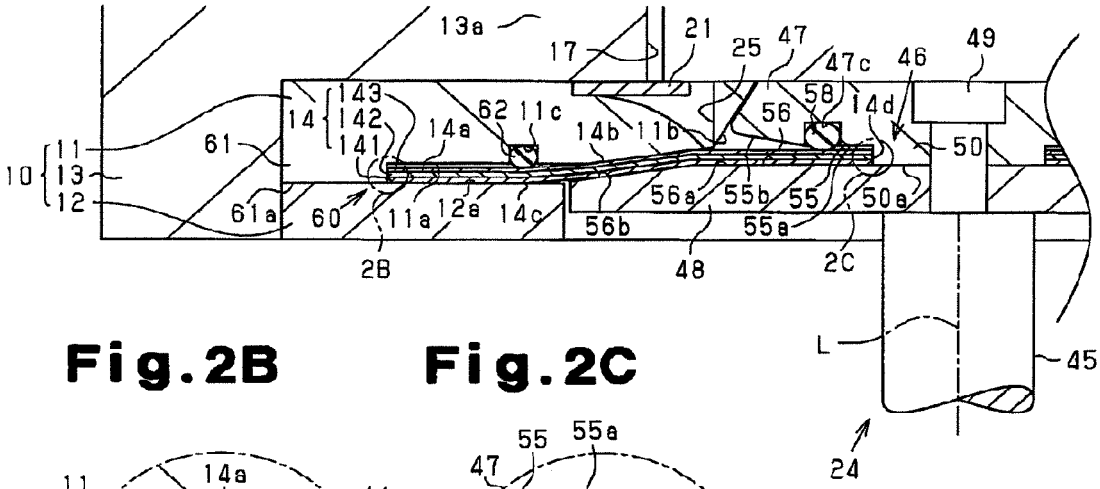
FIG. 2A is a cross sectional view showing a stale where the diaphragm unit of FIG. 1A is at the top dead center.

In case of the discharge process, during which the state of the diaphragm pump transitions from that in FIG. 1A to that in FIG. 2A, that is to say, in case where the degree of change in the form of the diaphragm unit 14 increases, a tensile force works on the diaphragm unit 14. As a result, the diaphragm unit 14 slides along the first movable surface 55 and the second movable surface 56 between the first movable surface 55 and the second movable surface 56. As shown in FIG. 2C, the inner peripheral portion of the diaphragm unit 14 slides away from the axial line L of the rod 45. The gap 101 shown in FIG. 2C is created between the diaphragm unit 14 and the movable spacer 50 due to the sliding of the diaphragm unit 14.

Figure 2B:
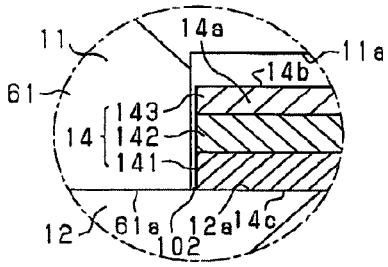
FIG. 2B is an enlarged view showing the outer peripheral portion of the diaphragm of FIG. 2A.
Figure 2C:
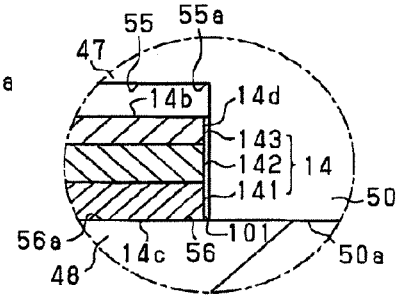
FIG. 2C is an enlarged view showing an inner peripheral portion of the diaphragm of FIG. 2A.

As shown in FIG. 2B, the diaphragm unit 14 slides along the first fixed surface 11*a* and the second fixed surface 12*a* between the first fixed surface 11*a* and the second fixed surface 12*a*. That is to say, the outer peripheral portion 14*a* of the diaphragm unit 14 slides toward the axial line L of the rod 45. The gap 102 shown in FIG. 2B is created between the diaphragm unit 14 and the fixed spacer 61 due to the sliding of the diaphragm unit 14.

In case of the suction process, during which the state transitions from that in FIG. 2A to that in FIG. 1A, that is to say, in case where the degree of change in the form of the diaphragm unit 14 decreases, the diaphragm unit 14 slides along the first movable surface 55 and the second movable surface 56 between the first movable surface 55 and the second movable surface 56. That is to say, the inner peripheral portion of the diaphragm unit 14 moves toward the axial line L of the rod 45. The outer peripheral portion 14*a* of the diaphragm unit 14 slides along the first fixed surface 11*a* and the second fixed surface 12*a* between the first fixed surface 11*a* and the second fixed surface 12*a*. In other words, the outer peripheral portion 14*a* of the diaphragm unit 14 moves away from the axial line L of the rod 45.

The present embodiment has the following advantages.

(1) The first movable surface 55 and the second movable surface 56 do not firmly sandwich the center portion of the diaphragm unit 14. The first fixed surface 11*a* and the second fixed surface 12*a* do not firmly sandwich the outer peripheral portion 14*a* of the diaphragm unit 14. Accordingly, stress accompanying the sandwiching is prevented from working excessively on the diaphragm unit 14. In addition, in case where the degree of change in the form of the diaphragm unit 14 increases, the diaphragm unit 14 slides between the first 10 movable surface 55 and the second movable surface 56, as well as between the first fixed surface 11*a* and the second fixed surface 12*a*, when a tensile force works on the diaphragm unit 14. Accordingly, an excessive tensile force is prevented from working on the diaphragm unit 11. Therefore, an excessive load is prevented from being applied to the diaphragm unit 14, and thus, the durability of the diaphragm unit 14 increases.

(2) The diaphragm unit 14 includes the first to third diaphragms 141-143 which are layered on top of each other. Each of the thickness of the first to third diaphragms 141-143 is smaller than the thickness of, for example, one diaphragm in case where only this diaphragm is charged with having the mechanical strength and reliability required for operating the diaphragm pump. Therefore, the degree of expansion is greater in the present embodiment in case where each of the first to third diaphragms 141-143 changes its form.

Accordingly, the amount of sliding of the diaphragm unit 14 which is required for the amount of displacement of the diaphragm unit 14 to reach a predetermined value is reduced. That is to say, the distance over which the first surface 14*b* slides along the first movable surface 55, the first fixed surface 11*a* and the peripheral surface of the hole 11*b* is reduced. Furthermore, the distance over which the second surface 14*c* slides along the second movable surface 56 and the second fixed surface 12*a* is also reduced. As a result, the amount of abrasion powder resulting from the friction caused by sliding of the diaphragm unit 14 is reduced. Therefore, the amount of powder resulting from the friction that enters the pump chamber is reduced, and the purity of the gas is prevented from lowering.

(3) The thickness of the first diaphragm 141 is greater than that of the third diaphragm 143. The thickness of the second diaphragm 142 is greater than that of the third diaphragm 143. The first diaphragm 141 and the second diaphragm 142 function as a strong diaphragm charged with having the mechanical strength and reliability required for defining the pump chamber 15 in order to operate the diaphragm pump. Thus, the mechanical-strength which the third diaphragm 143 facing the pump chamber 15 is required to have is small. Therefore, the range of choices of the material for the third diaphragm 143 becomes wide. As a result, the material for the third diaphragm 143 has resistance to corrosion by the gas in the pump chamber 15. The third diaphragm 143 functions as a barrier diaphragm.

(4) The third diaphragm 143 facing the pump chamber 15 is thinner than each of the first diaphragm 141 and the second diaphragm 142. Therefore, the degree of expansion of the third diaphragm 143 is greater than that of each of the first diaphragm 141 and the second diaphragm 142. As a result, the distance over which the third diaphragm 143 slides along the peripheral surface of the hole 11*b* and the first movable surface 55 is extremely small. Therefore, the amount of abrasion powder resulting from the friction of the diaphragm unit 14 accompanying the sliding is kept slight. The diaphragm pump of the present embodiment is appropriate for applications where the purity of a gas must be kept high, for example in semiconductor manufacturing factories.

(5) The first to third diaphragms 141-143 are layered on top of each other. As a result, the mechanical strength required for defining the pump chamber 15 is secured in the diaphragm unit 14. It is necessary for the diaphragm unit 14 to be provided with both a first characteristic of not easily changing its form against the gas pressure in the pump chamber 15, and a second characteristic of easily changing its form in response to the movement of the rod 45 in a reciprocating manner. In case where the thickness of, for example, one diaphragm, is increased so that the first characteristic is gained, the second characteristic is lost. Conversely, in case where the thickness of one diaphragm is reduced so that the second characteristic is gained, the first characteristic is lost. Accordingly, the diaphragm unit 14 where the first to third diaphragms 141-143 are layered on top of each other has both the first and second characteristics.

(6) The movable minimum gap S between the first movable surface 55 and the second movable surface 56 is set to no less than the thickness T of the diaphragm unit 14. In addition, the fixed minimum gap R between the first fixed surface 11*a* and the second fixed surface 12*a* is also set to no less than the thickness T of the diaphragm unit 14. Therefore, the movable support member 46 and the fixed support member 60 do not firmly sandwich the diaphragm unit 14, and ensure that the diaphragm unit 14 is slidable. That is to say, the diaphragm unit 14 can slide smoothly. Therefore, an excessive load is effectively prevented from being applied to the diaphragm unit 14, and the durability of the diaphragm unit 14 increases.

(7) The movable support member 46 is provided with a movable spacer 50 which defines the gap between the first movable surface 55 and the second movable surface 56. The first fixed member 11 is provided with a fixed spacer 61 which defines the gap between the first fixed surface 11*a* and the second fixed surface 12*a*. Accordingly, the movable minimum gap S between the first movable surface 55 and the second movable surface 56, as well as the fixed minimum gap R between the first fixed surface 11*a* and the second fixed surface 12*a*, is prevented without fail from being set smaller than the thickness T of the diaphragm unit 14.

That is to say, the movable spacer 50 makes it easier to control the gap between the first movable surface 55 and the second movable surface 56 at the time of the manufacture of the diaphragm pump. The fixed spacer 61 makes it easier to control the gap between the first fixed surface 11*a* and the second fixed surface 12*a* at the time of the manufacture of the diaphragm pump. Therefore, in case where the diaphragm unit 14 changes its form, the diaphragm unit 14 slides smoothly in the movable support member 46 and the fixed support member 60.

(8) The first diaphragm 141 and the second diaphragm 142, which do not face the pump chamber 15, have the same thickness. Thus, the strength of the diaphragm unit 14 is easier to set.

Figure 3:
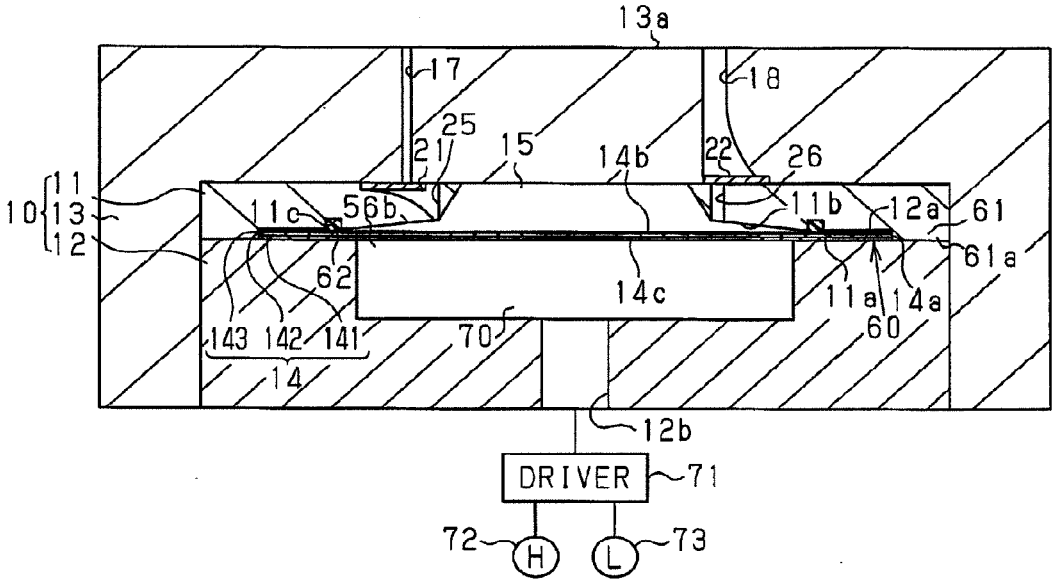
FIG. 3 is a cross-sectional view showing a diaphragm pump according to a second embodiment of the present invention.

Next, a second embodiment of the present invention is described in reference to FIG. 3. As shown in FIG. 3, a second fixed member 12 and a diaphragm unit 14 define a back pressure chamber 70. The back pressure chamber 70 is located on the side opposite to the pump chamber 15 with respect to the diaphragm unit 14. The back pressure chamber 70 is connected to an external driver 71 through a driving path 12*b* of the second fixed member 12. The driver 71 is capable of alternately switching the back pressure chamber 70 to a pressure supplying source 72, which is a high pressure region, and to an atmosphere with atmospheric pressure 73, which is a low pressure region, for example.

During the discharge process of the diaphragm pump, the back pressure chamber 70 is connected to the pressure supplying source 72. Thus, the pressure in the back pressure chamber 70 increases, which increases the difference in pressure between the back pressure chamber 70 and the pump chamber 15. As a result, the diaphragm unit 14 elastically changes its form, so as to move closer toward the lid 13*a*, and thus, the volume in the pump chamber 15 decreases.

Conversely, during the suction process of the diaphragm pump, the back pressure chamber 70 is connected to the atmosphere with the atmospheric pressure 73. Thus, the pressure in the back pressure chamber 70 decreases, which decreases the difference in the pressure between the back pressure chamber 70 and the pump chamber 15. As a result, the diaphragm unit 14 returns to a natural state, that is to say, the state of a plate, and thus, the volume in the pump chamber 15 increases.

It should be apparent to those skilled in the art that the present invention may be embodied in many other specific forms without departing from the spirit or scope of the invention. Particularly, it should be understood that the invention may be embodied in the following forms.

Figure 4:
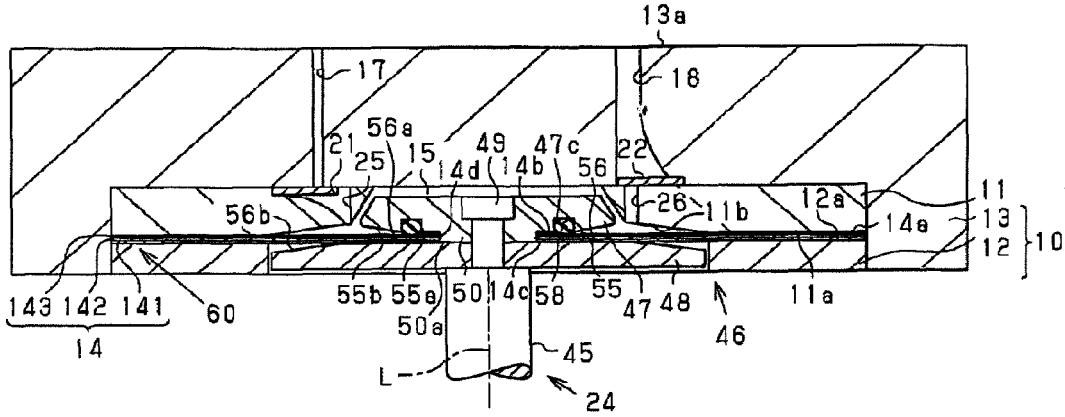
FIG. 4 is a cross-sectional view showing a diaphragm pump according to a modified embodiment of the present invention.

As shown in FIG. 4, the fixed ring 62 and the fixed spacer 61 may be omitted. Only the movable ring 58 and the movable support member 46 allow the diaphragm unit 14 to slide. In this case, the first fixed surface 11*a* and the second fixed 30 surface 12*a* may firmly sandwich the outer peripheral portion 14*a* of the diaphragm unit 14.

Figure 5:
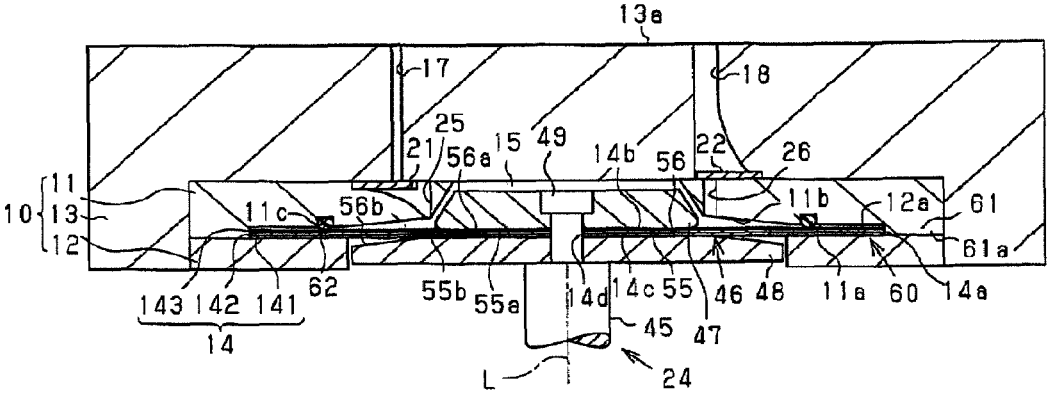
FIG. 5 is a cross-sectional view showing a diaphragm pump according to another modified embodiment of the present invention.
Figure 6:
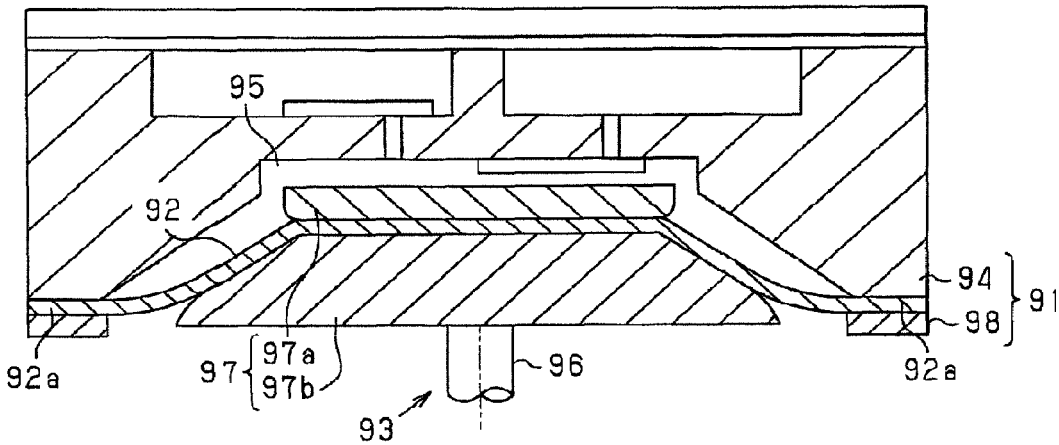
Fig.6(Prior Art)
FIG. 6 is a cross-sectional view showing a prior art diaphragm pump.

As shown in FIG. 5, the movable ring 58 and the movable spacer 50 may be omitted. Only the fixed ring 62 and the fixed support member 60 allow the diaphragm unit 14 to slide. In this case, the first movable surface 55 and the second movable surface 56 may firmly sandwich the center portion of the diaphragm unit 14.

The diaphragm unit 14 may include at least two diaphragms which are layered on top of each other. The second diaphragm 142 may be omitted, so that only the first diaphragm 141 and the third diaphragm 143 are layered to form the diaphragm unit 14. In this case, it is preferable for the third diaphragm 143 to be thinner than the first diaphragm 141.

The first to third diaphragms 141-143 may all have the same thickness or different thicknesses.

The movable spacer 50 may be integrally formed not with the first movable member 47 but with the second movable member 48. The fixed spacer 61 may be integrally formed not with the first fixed member 11 but with the second fixed member 12.

The movable spacer 50 may be a separate member from the first movable member 47 and the second movable member 48. The fixed spacer 61 may be a separate member from the first fixed member 11 and the second fixed member 12. In this case, the movable spacer 50 and the fixed spacer 61 are respective members in ring form.

The movable minimum gap S between the first movable surface 55 and the second movable surface 56 can be set slightly smaller than the thickness T of the portion of the diaphragm unit 14 between the first movable surface 55 and the second movable surface 56. Concretely, the maximum value of the difference between the movable minimum gap S and the thickness T can be allowed to be up to 10% of the thickness T.

In addition, the fixed minimum gap R between the first fixed surface 11*a* and the second fixed surface 12*a* may be set slightly smaller than the thickness T of the portion of the diaphragm unit 14 between the first fixed surface 11*a* and the second fixed surface 12*a*. Concretely, the maximum value of the difference between the fixed minimum gap R and the thickness T can be allowed to be up to 10% of the thickness T.

That is to say, the diaphragm unit 14 should only be able to slide relative to the movable support member 46 and the fixed support member 60 when the diaphragm unit 14 changes its form. In case where it is ensured that the diaphragm unit 14 is slidable, the movable ring 58 may be omitted, so that the first movable surface 55 and the second movable surface 56 directly sandwich the diaphragm unit 14. In the same manner, in case where it is ensured that the diaphragm unit 14 is slidable, the fixed ring 62 may be omitted, so that the first fixed surface 11*a* and the second fixed surface 12*a* directly sandwich the diaphragm unit 14.

The joining force of the second fixed member 12 to the first fixed member 11 may be relaxed, so that the diaphragm unit 14 can slide between the first fixed surface 11*a* and the second fixed surface 12*a*. Tightening of bolts (not shown) for fixing the second fixed member 12 to the first fixed member 11 may be set loosely, for example.

The force for tightening the bolts 49 for fixing the first movable member 47 to the second movable member 48 may be relaxed, and thereby, sliding of the diaphragm unit 14 may be allowed.

A sealing member, such as an O ring, may be placed between the second movable surface 56 and the second surface 14*c* of the diaphragm unit 14.

The movable ring 58 and the fixed ring 62 may be lip seals.

The diaphragm pump according to the present invention is not limited to sending a gas, and may send a liquid.

The present examples and embodiments are to be considered as illustrative and not restrictive and the invention is not to be limited to the details given herein, but may be modified within the scope and equivalence of the appended claims.

What is claimed:

1. A diaphragm pump, comprising:

a case;

a diaphragm unit comprising a plurality of diaphragms which are layered on top of each other, wherein the case and the diaphragm unit define a pump chamber, the diaphragm unit has a first surface and a second surface on the side opposite to the first surface, and wherein, when the diaphragm unit changes its form, the volume in the pump chamber increases or decreases, and as a result, a fluid flows into or out of the pump chamber; and a support member for supporting the diaphragm unit, wherein the support member has a first support surface for supporting the first surface and a second support surface for supporting the second surface, and the support member allows the diaphragms to slide between the first support surface and the second support surface in case where the diaphragm unit changes its form, wherein a minimum gap between the first support surface and the second support surface is set to a value no less than the thickness of the diaphragm unit.

2. The diaphragm pump according to claim 1, wherein the diaphragm unit has an outer peripheral portion, and the pump further comprises:

a driven body which moves in a reciprocating manner;

a first support member for linking the driven body to the diaphragm unit, wherein the diaphragm unit changes its form when the driven body moves in a reciprocating manner; and a second support member for supporting the outer peripheral portion against the case, wherein the support member allowing the diaphragms to slide is at least one of the first support member and the second support member.

3. The diaphragm pump according to claim 1, further comprising:

a back pressure chamber which is located on the side of the diaphragm unit opposite to the pump chamber, wherein the back pressure chamber is defined by the diaphragm unit and the case, and the diaphragm unit changes its form due to a change in the difference in pressure between the back pressure chamber and the pump chamber, wherein the support member allowing the diaphragms to slide supports the diaphragm unit against the case.

4. The diaphragm pump according to claim 1, wherein the diaphragms include a barrier diaphragm facing the pump chamber and a strong diaphragm on the side of the barrier diaphragm opposite to the pump chamber, and wherein the barrier diaphragm is thinner than the strong diaphragm.

5. The diaphragm pump according to claim 4, wherein the strong diaphragm is one of two or more strong diaphragms, and wherein the thicknesses of the strong diaphragms are set to be the same.

6. The diaphragm pump according to claim 2, further comprising:

at least one of a first sealing member for sealing a portion between the first support member and the diaphragm unit, and a second sealing member for sealing a portion between the second support member and the diaphragm unit, wherein the first sealing member and the second sealing member are placed in at least one of a portion between the first support surface and the first surface, and a portion between the second support surface and the second surface.

7. The diaphragm pump according to claim 2, wherein the first surface faces the pump chamber, and the second surface faces the side opposite to the pump chamber, wherein the first support surface has a first movable surface provided on the first support member and a first fixed surface provided on the second support member, wherein the second support surface has a second movable surface provided on the first support member and a second fixed surface provided on the second support member, and wherein the diaphragms are allowed to slide in at least one of a portion between the first movable surface and the second movable surface, and a portion between the first fixed surface and the second fixed surface.

8. A diaphragm pump, comprising:

a case;

a diaphragm unit comprising a plurality of diaphragms which are layered on top of each other, wherein the case and the diaphragm unit define a pump chamber, the diaphragm unit has a first surface facing the pump chamber and a second surface on the side opposite to the first surface, wherein, when the diaphragm unit changes its form, the volume in the pump chamber increases or decreases, and as a result, a fluid flows into or out of the pump chamber, and wherein it is possible for the diaphragms to slide against each other;

a support member for supporting the diaphragm unit, wherein the support member has a first facing surface which faces the first surface and a second facing surface which faces the second surface; and a sealing member which is placed in at least one of a portion between the first surface and the first facing surface, and a portion between the second surface and the second facing surface, wherein a minimum gap between the first facing surface and the second facing surface is set to a value greater than the thickness of the diaphragm unit in the portion corresponding to the sealing member.

9. The diaphragm pump according to claim 8, wherein the diaphragm unit has an outer peripheral portion, and the pump further comprises:

a driven body which moves in a reciprocating manner;

a first support member for linking the driven body to the diaphragm unit, wherein the diaphragm unit changes its form when the driven body moves in a reciprocating manner; and a second support member for supporting the outer peripheral portion against the case, wherein the support member allowing the diaphragms to slide is at least one of the first support member and the second support member.

10. The diaphragm pump according to claim 8, further comprising:

a back pressure chamber which is located on the side of the diaphragm unit opposite to the pump chamber, wherein the back pressure chamber is defined by the diaphragm unit and the case, and the diaphragm unit changes its form due to a change in the difference in pressure between the back pressure chamber and the pump chamber, wherein the support member allowing the diaphragms to slide supports the diaphragm unit against the case.

11. A diaphragm pump, comprising:

a case;

a diaphragm unit comprising a plurality of diaphragms which are layered on top of each other, wherein the case and the diaphragm unit define a pump chamber, the diaphragm unit has a first surface and a second surface on the side opposite to the first surface, and wherein, when the diaphragm unit changes its form, the volume in the pump chamber increases or decreases, and as a result, a fluid flows into or out of the pump chamber; and a support member for supporting the diaphragm unit, wherein the support member has a first support surface for supporting the first surface and a second support surface for supporting the second surface, and the support member allows the diaphragms to slide between the first support surface and the second support surface in case where the diaphragm unit changes its form, wherein the support member comprises a spacer which defines a minimum gap between the first support surface and the second support surface.

* * * * *